US005636732A

United States Patent [19]

Gilels et al.

[11] Patent Number: 5,636,732

[45] Date of Patent: Jun. 10, 1997

[54] CAP FOR PACKAGE OF CHEWING GUM

[76] Inventors: Lisa A. Gilels, 1114 W. Lynwood, Phoenix, Ariz. 85007; Terry J. Adams, 132 S. Central, Suite 6, Phoenix, Ariz. 85004

[21] Appl. No.: 335,178

[22] Filed: Nov. 7, 1994

[51] Int. Cl.[6] ..... A45C 11/00

[52] U.S. Cl. ..... 206/37; 206/800; 220/254; 220/259; 220/339

[58] Field of Search ..... 220/254, 259, 220/334, 337, 339; 206/37, 800, 39, 39.5, 39.6

[56] References Cited

U.S. PATENT DOCUMENTS

| | | | |
|---|---|---|---|
| 2,380,367 | 7/1945 | Ranney | 206/800 |
| 3,131,410 | 5/1964 | Anderson et al. | 220/281 |
| 3,217,949 | 11/1965 | Davis | 220/254 X |
| 3,417,897 | 12/1968 | Johnson | 220/339 X |
| 3,421,654 | 1/1969 | Hexel | 220/339 X |
| 4,034,885 | 7/1977 | Hunckler et al. | 220/254 X |
| 4,144,985 | 3/1979 | Kinslow | 220/254 |
| 4,538,731 | 9/1985 | Cillario | 220/254 X |
| 5,002,197 | 3/1991 | Ponsi | 220/259 X |

FOREIGN PATENT DOCUMENTS

| | | | |
|---|---|---|---|
| 393179 | 10/1965 | Switzerland | 220/337 |

*Primary Examiner*—Allan N. Shoap
*Assistant Examiner*—Nathan Newhouse
*Attorney, Agent, or Firm*—Harry M. Weiss; Jeffrey D. Moy; Harry M. Weiss & Associates, P.C.

[57] ABSTRACT

A package containing sticks of chewing gum is opened at one end to expose the sticks. A cap is placed on the open end of the package and has a frame which surrounds the open end. The frame has two windows each of which is juxtaposed with a group of the chewing gum sticks. A pair of covers for the windows is pivotally mounted on the frame.

3 Claims, 1 Drawing Sheet

CAP FOR PACKAGE OF CHEWING GUM

BACKGROUND OF THE INVENTION

1. Field of the Invention

The invention relates to a cap for an open package of discrete commodities.

2. Description of the Related Art

Once a package of chewing gum has been opened, there is nothing to prevent the sticks of gum from falling out of the package. The sticks of gum can accordingly scatter as the package is carried around, e.g., in a woman's pocketbook.

U.S. Pat. Nos. 5,029,712 and 5,125,211 disclose caps which can be placed over an open end of a package of chewing gum to hold the chewing gum sticks in the package. The caps have an opening which can be uncovered to gain access to the chewing gum sticks.

These known caps do not allow easy access to both sides of a package so that removal of the chewing gum sticks from one side of the package is difficult.

SUMMARY OF THE INVENTION

It is an object of the invention to provide a cap which, while capable of retaining commodities in an opened package, permits the commodities to be controllably removed from the package.

Another object of the invention is to provide a cap which, when placed on an opened package of commodities to prevent escape of the commodities, allows relatively simple access to all of the commodities.

An additional object of the invention is to provide a method which enables commodities in an opened package to be confined yet permits the commodities to be withdrawn from the package in a controlled manner.

A further object of the invention is to provide a method which can prevent the escape of commodities from an opened package while nevertheless allowing all of the commodities to be accessed with relative ease.

The preceding objects, as well as others which will become apparent as the description proceeds, are achieved by the invention.

One aspect of the invention resides in a cap for a package of discrete commodities, particularly sticks of chewing gum, having exposed ends. The cap comprises a frame-like element for embracing the exposed ends. The frame-like element has a first open section for framing first ones of the exposed ends, and a second open section for framing second ones of the exposed ends. The cap further comprises a cover for each of the open sections.

With the covers in place, the cap of the invention can prevent the escape of commodities from an opened package. Yet, the commodities can be readily accessed simply by opening a cover. The provision of more than one cover makes it possible, by appropriate design of the cap, to gain access to both sides of a package.

Another aspect of the invention resides in a method of retrieving discrete commodities having exposed ends from an open package. The method comprises the steps of covering the exposed ends, revealing first ones of the ends following the covering step, and withdrawing one of the commodities from the package by means of one of the first ends. The method additionally comprises the steps of uncovering second ones of the ends, and removing another of the commodities from the package by means of one of the second ends.

The method may also comprise the steps of re-covering the remainder of the first ends following the withdrawing step and preceding the uncovering step, and re-covering the remainder of the second ends following the removing step. At least one of the re-covering steps can be performed using snap action.

Additional features and advantages of the invention will become apparent from the following detailed description of preferred embodiments when read in conjunction with the accompanying drawings.

DESCRIPTION OF THE PREFERRED EMBODIMENTS

Figure 1:
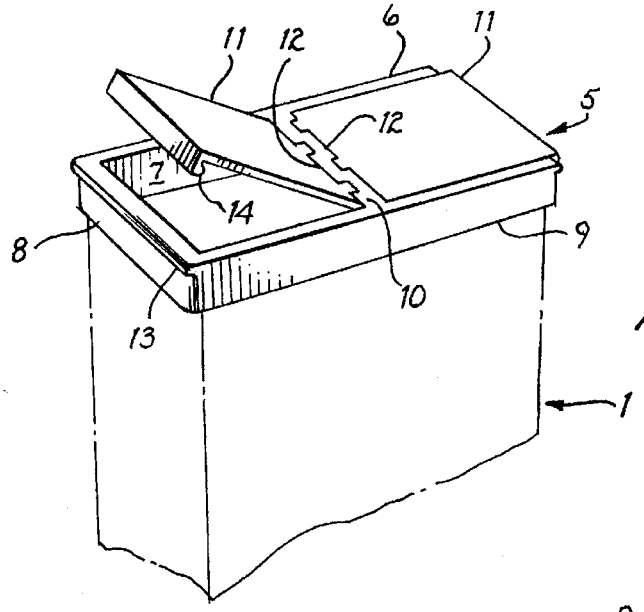
FIG. 1 is a perspective view of a cap in accordance with the invention, the cap being mounted on an opened package.
Figure 2:
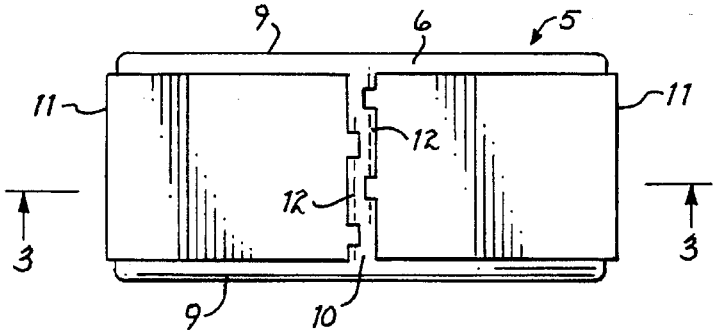
FIG. 2 is a plan view of the cap of FIG. 1.
Figure 3:
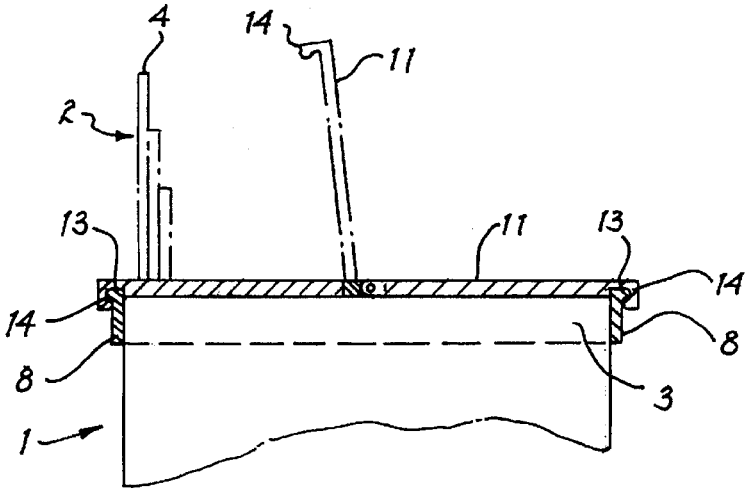
FIG. 3 is a sectional view as seen in the direction of the arrows 3—3 of FIG. 2.

Referring to FIGS. 1–3, the reference numeral 1 identifies a package of discrete commodities 2. The package 1 is here a package of chewing gum and the discrete commodities 2 are individual sticks of gum. The package 1 has an end 3 which has been opened to expose ends 4 of the chewing gum sticks 2, and the chewing gum sticks 2 can be withdrawn from the package 1 via the open package end 3 by pulling on the ends 4.

In order to prevent the chewing gum sticks 2 from falling out of the package 1 as the package 1 is carried around, a cap 5 is mounted on the open package end 3. The package 1 has a rectangular cross section, and the cap 5 comprises a frame or frame-like element 6 which is rectangular so as to conform to the cross section of the package 1. The frame 6 is provided with a pair of open sections or window sections 7 of which only one is visible in the drawings. The window sections 7, which are square or rectangular, are arranged side-by-side as seen lengthwise on the frame 6. Each of the window sections 7 is juxtaposed with a respective group of chewing gum stick ends 4, and each group of ends 4 is framed by the respective window sections 7.

The frame 6 embraces or surrounds, and is a friction fit on, the open package end 3 and the chewing gum stick ends 4.

The frame 6 includes a pair of parallel short sides 8, a pair of parallel long sides 9, and a strap or rib 10 which is located between the two window sections 7. The strap 10 runs parallel to the short sides 8, and bridges the long sides 9, of the frame 6.

A cover 11 is provided for each of the window sections 7 and is pivotable between a closed position in which the respective window section 7 is covered and an open position in which the respective window section 7 is uncovered. The covers 11, which are disposed side-by-side as seen lengthwise on the frame 6, are pivotally mounted on the strap 10 by means of hinges 12. The covers 11 are arranged so that the left-hand cover 11 rotates in a clockwise direction during movement from the closed position to the open position while the right-hand cover 11 rotates in a counterclockwise direction during movement from the closed position to the open position. Similarly, the two covers 11 rotate in opposite directions during movement from the open positions to the closed positions.

Each of FIGS. 1, 2, and 3 shows the right-hand cover 11 in its closed position. In contrast, the left-hand cover 11 is shown in a partially open position in FIG. 1 and in both the closed and fully open positions in FIG. 3. The closed position of the left-hand cover 11 in FIG. 3 is illustrated in full lines and the fully open position in phantom lines.

The strap 10 serves a dual function. On the one hand, the strap 10 constitutes a mount or bearing for the covers 11. On the other hand, the strap 10 constitutes an abutment which prevents the cap 5 from being pushed too far onto the package 1.

A lip 13 is provided on each short side 8 of the frame 6 whereas a lip 14 is provided on the free end of each cover 11. The lips 13 are complementary to the lips 14 and are designed to lock with the lips 14 in the closed positions of the covers 11. The lips 13 and 14 constitute cooperating coupling portions which serve to arrest the covers 11 in the closed positions of the covers 11. It is preferred for the lips 13 and 14 to be designed in such a manner that the lips 13 and 14 lock to one another by snap action.

In operation, the end 3 of the package 1 is opened and the cap 5 is pushed onto the open package end 3 until the strap 10 contacts the adjacent chewing gum stick ends 4. The covers 11 are in the closed positions so that the chewing gum stick ends 4 are covered. The chewing gum sticks 2 are thus confined in the package 1 which can accordingly be carried around without the chewing gum sticks 2 falling out.

When it is desired to remove a chewing gum stick 2 from the package 1, one of the covers 11 is opened to expose a first group of chewing gum stick ends 4. For the purpose of the present description, it is assumed that the left-hand cover 11 is opened. A chewing gum stick 2 is withdrawn from the left side of the package 1 via the left-hand window section 7 by pulling on one of the chewing gum stick ends 4 of the first group. Once the chewing gum stick 2 has been retrieved, the left-hand cover 11 is closed by snapping the lip 14 of the left-hand cover 11 over the cooperating lip 13 of the frame 6.

Since the first chewing gum stick 2 was withdrawn from the left side of the package 1, subsequent chewing gum sticks 2 will normally also be withdrawn from the left side of the package 1. When no more chewing gum sticks 2 are available on the left side of the package 1, the right-hand cover 11 is used to gain access to the chewing gum sticks on the right side of the package 1. Thus, the right-hand cover 11 is swung open to uncover a second group of chewing gum stick ends 4. The chewing gum sticks 2 on the right side of the package 1 are then removed from the package 1 through the right-hand window section 7 by pulling on the chewing gum stick ends 4 of the second group.

After all of the chewing gum sticks 2 have been consumed, the empty package 1 is removed from the cap 5 and discarded.

The friction fit of the cap 5 on the package 1 and the locking of the covers 11 to the frame 6 allow the cap 5 to reliably retain the chewing gum sticks 2 in the package 1. Nevertheless, the chewing gum sticks 2 are readily accessible upon demand by simply swinging open the covers 11. The provision of a cover 11 for either side of the package 1 permits all of the chewing gum sticks 2 in the package 1 to be retrieved with ease.

The cap 5 can be made of plastic or metal.

While the invention has been particularly shown and described with reference to the preferred embodiments thereof, it will be understood by those skilled in the art that changes in form and detail may be made without departing from the spirit and scope of the invention.

What is claimed is:

1. A combination cap and open chewing gum package comprising, in combination:

a package having sticks of chewing gum located within said package and having ends of said sticks of chewing gum exposed at one end of said package;

a cap located around a perimeter portion of said one end of said gum package and comprising a frame-like element embracing the exposed ends of said sticks of chewing gum; said frame-like element having a first open section defining one half of said package and framing a first group of the exposed ends of said sticks of chewing gum and a second open section defining the other half of said package and framing a second group of the exposed ends of said sticks of chewing gum, said frame-like element further comprising a single strap member extending midway between said first open section and said second open section; and a pair of covers, one of said pair of covers for said first open section and the other of said pair of covers for said second open section, each one of said pair of covers pivotally mounted on said single strap member selectively exposing or closing the open section located beneath each cover, said frame-like element is substantially rectangular and each said open section is arranged side-by-side as seen lengthwise on said frame-like element, each of said pair of covers has an open position and a closed position, said frame-like element and at least one of said covers being provided with cooperating coupling portions for arresting said cover in the closed position, said coupling portions comprise a first lip extending radially outwardly from said frame-like element and a second lip on said cover.

2. The combination cap and open chewing gum package of claim 1 wherein said coupling portions are designed for snap action.

3. The combination cap and open chewing gum package of claim 1 wherein one of said pair of covers being pivotable from an open position to a closed position in a clockwise direction and the other of said pair of covers being pivotable from an open position to a closed position in a counter-clockwise direction.

* * * * *